US008776886B2

(12) United States Patent
Rondeau

(10) Patent No.: US 8,776,886 B2
(45) Date of Patent: Jul. 15, 2014

(54) APPARATUS AND METHOD FOR LAUNCHING PLUGS IN CEMENTING OPERATIONS

(75) Inventor: Joel Rondeau, Antony (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 525 days.

(21) Appl. No.: 13/139,561

(22) PCT Filed: Dec. 1, 2009

(86) PCT No.: PCT/EP2009/008655

§ 371 (c)(1),
(2), (4) Date: Jun. 14, 2011

(87) PCT Pub. No.: WO2010/072319

PCT Pub. Date: Jul. 1, 2010

(65) Prior Publication Data

US 2011/0240316 A1 Oct. 6, 2011

(30) Foreign Application Priority Data

Dec. 22, 2008 (EP) ..... 08172652

(51) Int. Cl.
*E21B 33/16* (2006.01)
*E21B 33/05* (2006.01)

(52) U.S. Cl.
CPC ..... *E21B 33/05* (2013.01); *E21B 33/16* (2013.01)
USPC ..... 166/318; 166/153

(58) Field of Classification Search
CPC ..... E21B 33/16
USPC ..... 166/153, 154, 155, 156, 318
See application file for complete search history.

(56) References Cited

U.S. PATENT DOCUMENTS

| | | | | |
|---|---|---|---|---|
| 3,434,539 | A * | 3/1969 | Merritt | 166/153 |
| 5,769,161 | A * | 6/1998 | Borden | 166/72 |
| 5,890,537 | A | 4/1999 | Lavaure | |
| 6,959,766 | B2 * | 11/2005 | Connell | 166/373 |

FOREIGN PATENT DOCUMENTS

| | | |
|---|---|---|
| EP | 0450676 | 9/1991 |
| EP | 0869257 | 7/1998 |
| WO | 98/25004 | 11/1998 |

* cited by examiner

*Primary Examiner* — Giovanna Wright
*Assistant Examiner* — Richard Alker
(74) *Attorney, Agent, or Firm* — Michael Dae

(57) ABSTRACT

An apparatus for use in launching cement plugs in a well cementing operation, comprising: —a cylinder (104) having ports (106) defined in a portion of the wall thereof; —a piston (108) slideably received in the bore of the cylinder below the ports; and —an actuator (110) extending from the piston through the cylinder and operable by the piston for launching a plug from the apparatus into the well; wherein the apparatus further comprises an elongate sleeve valve member located in the cylinder above the piston, the sleeve valve member (112) comprising at least one ball seat (114*a*-114*c*) for receiving a ball to block the interior of the cylinder, sleeve ports formed in the sleeve above the ball seat, and a spacer (118) extending between the ball seat and the piston.

19 Claims, 12 Drawing Sheets

APPARATUS AND METHOD FOR LAUNCHING PLUGS IN CEMENTING OPERATIONS

TECHNICAL FIELD

This invention relates to apparatus and methods for launching plugs in cementing operations of the type found when constructing wells in the oil and gas industry. In particular, the invention relates to the use of a ball drop system for controlling the movement of a piston in a plug launcher.

BACKGROUND ART

In the construction of oil and gas wells, it is occasionally necessary to cement a liner or casing in the well to provide stability and zonal isolation. In such processes, it is common to use plugs to separate different fluids pumped along the tubing or casing. Such plugs are usually installed in a basket located in cementing equipment lowered into the well. The plugs are launched from the basket by means of darts pumped from the surface.

A known cement plug launching tool (see U.S. Pat. No. 5,890,537) is shown in FIGS. 1-3. The body 32 of the launching tool includes an upper tubular housing 40 whose upper end is threaded to the mandrel of the liner setting tool, and whose lower end is threaded at 41 to a spacer tube 42. A sleeve valve 44 which is slidable in the bore of the housing 40 is biased upward to a normally open position with respect to ports 38 by a coil spring 46.

A piston 50 connected to a drive rod 36 slides in the bore of the spacer tube 42 which is connected to the upper end of a cylinder tube 55. A lower piston 58 is formed on the rod 36 and slides within the bore 60 of the cylinder tube 55 which is filled with a suitable hydraulic oil. The piston 58 has an outer diameter that provides a selected clearance with respect to the wall of the bore 60 such that, as the piston is forced downward with the rod 36, a metering effect is created which retards the rate of downward movement.

The lower end of the cylinder tube 55 is connected to the upper end of the basket 33 which initially houses the upper and lower wiper plugs 34, 35, and is provided with a plurality of longitudinal slots 68 that receive radial stop pins 70 which extend from the outer periphery of a drive flange 75 that rests on top of the upper plug 34. A head 71 on the upper end of the upper plug 34 receives the inner ends of several radially extending shear pins 73 on the drive flange 75 to releasably couple the plug 34 to the flange.

In operation and use, the liner is run and suspended by a hanger from a point near the lower end of the casing which is below the wellhead. The plug launcher tool is connected to the lower end of the mandrel, and the wiper plugs 34 and 35 were previously loaded into the basket 33. The drive rod 36 is in its upper position where the piston 58 is at the upper end of the oil chamber 60. The ports 38 in the housing 40 are open so that fluids can flow therethrough. A dart launcher is provided at the surface.

In order to cement the liner in place, cement slurry is pumped in through the dart launcher, and then a valve is opened to release a lower dart 101. Pressure is applied to the top of the dart 101 to force it through the valve and down into the drill pipe ahead of the cement. Eventually the dart 101 enters the housing 40, passes into the bore of the valve sleeve 44, and to a position where its nose bumps against the drive head 50 of the rod 36. Since the elastomer cups of the dart 101 seal off the bore of the valve sleeve 44, pressure causes the sleeve valve to shift downward against the bias of the coil spring 46, and in so doing, partially close off the radial ports 38.

Pressure on the dart 101 applies downward force to the rod 36 and causes it to shift downward in the body 32, thereby driving both the upper and lower wiper plugs 34 and 35 downward. Such movement is slowed by the action of hydraulic oil that meters upward through the clearance between the piston 58 and the inner wall of the cylinder 60 so that shock loads are dissipated. When the pins 70 on the drive plate 75 reach the bottoms of the slots 68 as shown in FIG. 2, downward movement of the upper plug 34 is stopped. However the lower plug 35 will have been ejected from the bottom of the basket 33 and into the bore of the liner. At about the same time as the stop pins 70 encounter the bottoms of the slots 68, the top cup of the dart 101 clears the bottom of the sleeve valve 44 so that the ports 38 are re-opened as the sleeve valve is shifted upward by the coil spring 46. Pumping of cement is continued until the desired number of barrels of cement has been placed within the liner.

When the proper amount of cement has been pumped into the running string, the upper dart 100 is forced into the drill pipe, followed by whatever fluid is being pumped behind it. The dart 100 travels down through the running string, the mandrel, and into the housing 40. When the cups of the dart 100 enter the valve sleeve 44 and seal off its bore, the valve sleeve shifts downward to close off the lateral ports 38. The dart 100 then engages the lower dart 101, so that applied pressures force the drive rod 36 further down in the body 32 as shown in FIG. 3. The pins 73 are sheared so that the drive disc 66 on the lower end of the rod 32 passes through the plate 75 and forces ejection of the upper wiper plug 34 from the bottom of the basket 33. The metering of oil past the piston 58 again slows or retards downward movement of the rod 32 so that ejection is smoothed. When the top end of the dart 100 clears the bore of the valve sleeve 44, the valve sleeve again opens, as before, so that displacement fluids flow around the outside of the launcher assembly and through the annular space between the basket 33 and the inner wall of the liner. A positive indication of the launching of wipers plugs 34 and 35 from basket 33 is shown by an increase in pumping pressure at the surface location resulting from the cushioned travel of piston 58 for both plugs 34 and 35. The shearing of pins 73 for upper plug 34 additionally increases the pumping pressure for upper plug 34. For example, the increase in the pumping pressure may amount to about 1500 psi for lower plug 35 and to about 3000 psi for upper plug 34.

As is discussed above, the plug launching system is activated by the launch of one or more darts. Darts are launched from modules that are operated by opening and closing a series of valves. Where more than one dart is launched the complexity of the dart launching equipment increases. Not only does this require more physical space but the process of opening and closing sets of valves makes the operation more complex and thereby less efficient. The increased complexity also means that the system is more prone to breaking down. In contrast ball dropping modules, which are commonly used to terminate operations, are more compact and much simpler mechanically. The major disadvantage of replacing darts with balls in such operations is that a ball is insufficient in length to provide the necessary stroke length to launch a plug.

DISCLOSURE OF THE INVENTION

A first aspect of the invention provides apparatus for use in launching cement plugs in a well cementing operation, comprising:

a cylinder having ports defined in a portion of the wall thereof;

a piston slideably received in the bore of the cylinder below the ports; and an actuator extending from the piston through the cylinder and operable by the piston for launching a plug from the apparatus into the well;

wherein the apparatus further comprises an elongate sleeve valve member located in the cylinder above the piston, the sleeve valve member comprising at least one ball seat for receiving a ball to block the interior of the cylinder, sleeve ports formed in the sleeve above the ball seat, and a spacer extending between the ball seat and the piston.

Preferably, the sleeve valve member comprises a series of ball seats spaced one above the other, sleeve ports being provided in the sleeve above each ball seat. In this case, the sleeve ports can be spaced apart by a distance corresponding to the amount of movement required for the piston to launch a plug from the apparatus.

Blocking of the seat by a ball allows the sleeve to be advanced by application of fluid pressure above the ball seat until the corresponding sleeve ports are aligned with the cylinder ports. Each ball seat typically comprises an aperture that can be closed by a ball, the apertures becoming progressively larger from bottom to top.

The apparatus preferably further comprises at least one ball comprising a solid core and a compressible outer layer. The size of the ball is typically sufficient to substantially block the cylinder while allowing the ball to be pumped along the cylinder by fluid pressure. It is particularly preferred that the apparatus comprises a series of balls, each having a different sized core. The outer layer can be sufficiently compressible to allow a ball with a smaller core to pass through the aperture of a seat for a larger ball core. Balls with different sized cores can be identifiable by colour coding of the outer layer corresponding to core size.

The apparatus typically further comprises a basket containing one or more cement plugs that can be launched from the basket by means of the action of the piston and actuator.

A second aspect of the invention provides a method of launching a cement plug in a well cementing operation comprising the steps of:

pumping a first ball through the sleeve valve member so as to pass through an upper ball seat and seat in the lowest ball seat and block fluid flow through the sleeve member;

applying fluid pressure above the first ball so as to urge the sleeve valve member downwards in the cylinder to a first position in which the sleeve ports above the lowest ball seat are in alignment with the cylinder ports;

pumping a second ball through the sleeve valve member so as to seat in the upper ball seat and block fluid flow through the sleeve valve member; and applying fluid pressure above the second ball so as to urge the sleeve valve member downwards in the cylinder to a second position in which the sleeve ports above the upper ball seat are in alignment with the cylinder ports;

wherein the motion of the sleeve valve member when moving between the starting position and the first position, and between the first position and the second position is transmitted via the spacer, piston and actuator to launch cement plugs from the apparatus.

When the sleeve valve member comprises one or more further ball seats above the upper ball seat, the method can comprise pumping further balls to seat in the further ball seats and applying fluid pressure above the balls so as to further move the sleeve valve member to third and subsequent positions.

A third plug may be launched by the pumping of a third ball and blocking the ball seat immediately upstream of that blocked by the second ball thereby advancing the sliding sleeve downwards and launching a third plug, and arresting the downward movement of the sliding sleeve by aligning the corresponding sleeve ports with the cylinder ports.

MODE(S) FOR CARRYING OUT THE INVENTION

Figure 1:
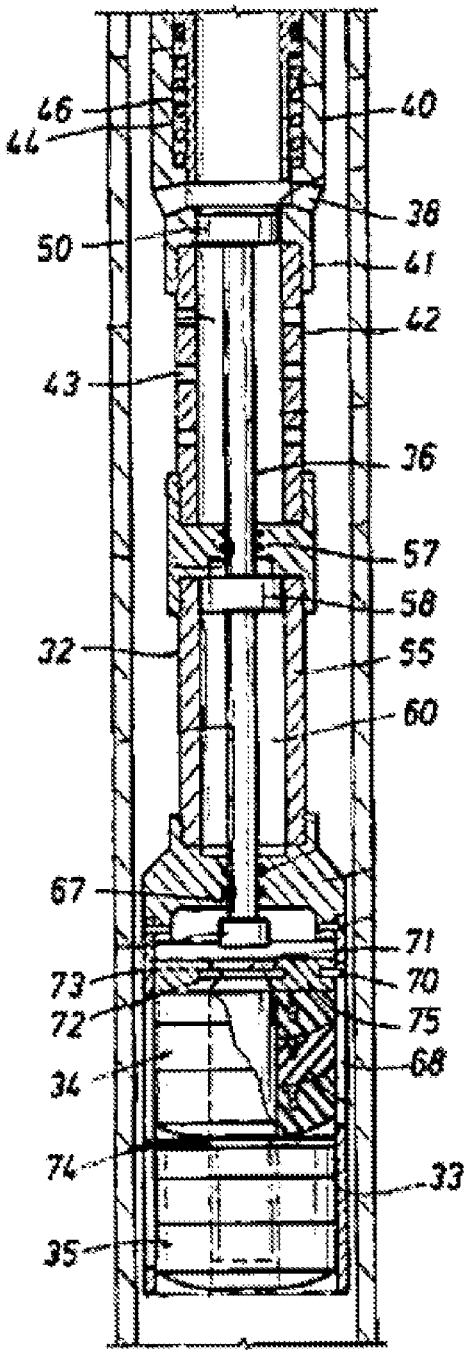
Figure 1 PRIOR ART
FIGS. 1-3 show operation of a prior art system.
Figure 2:
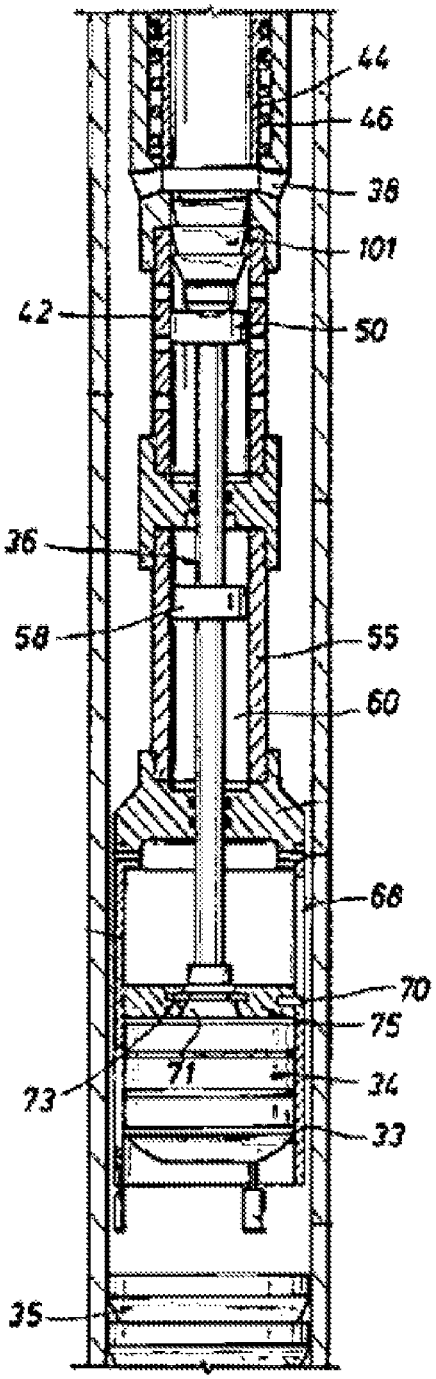
Figure 2 PRIOR ART
Figure 3:
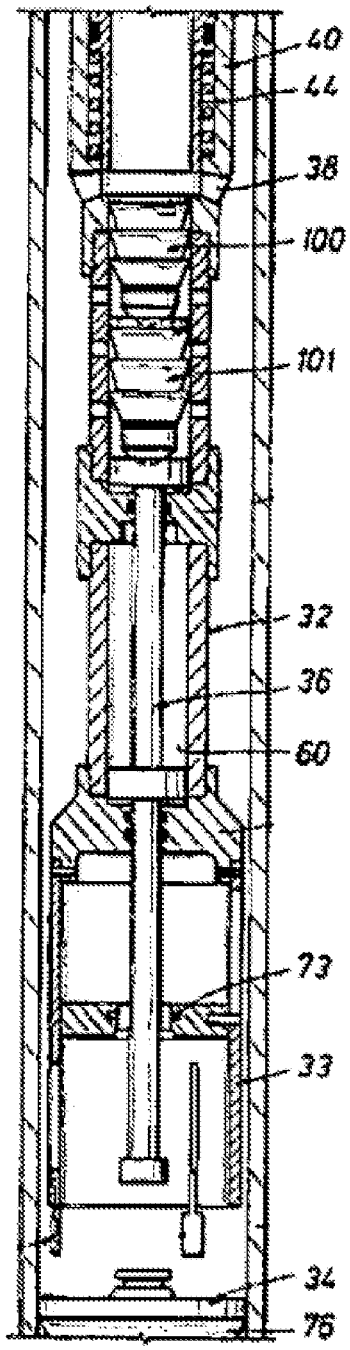
Figure 3 PRIOR ART

This invention provides apparatus and a method for deploying balls that replace the darts used to launch cement plugs shown in FIGS. 1-3 discussed above. Ball dropper modules provided at the surface of the well are well-known in this art, balls typically being dropped in operations to activate or deactivate downhole systems or provide a pressure barrier against which pressure can be applied to shear pins or joints downhole to detach equipment. The present invention uses a standard ball dropper module which will not be described further. Ball dropper modules have the advantage over surface dart launchers in that they are more compact and mechanically less complex making the operation more efficient.

Figure 4A:
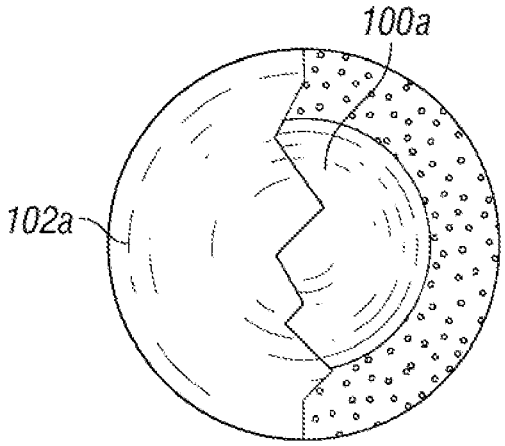
FIGS. 4A to 4C show the balls used to activate the plug launching device.
Figure 4B:
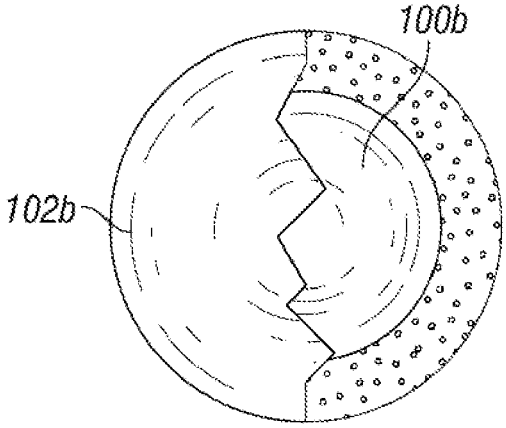
Figure 4C:
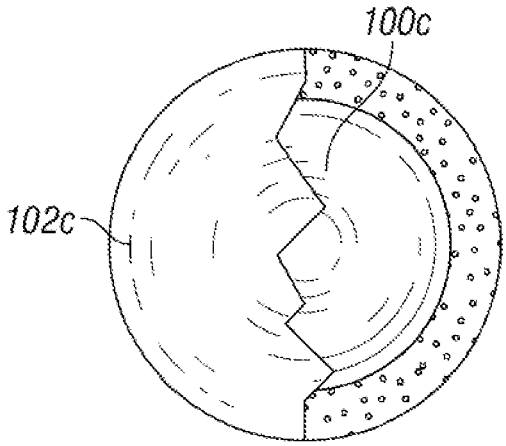

FIGS. 4A to 4C show three balls that can be used to activate the plug launching device. Each ball comprises a solid inner core 100*a-c* of varying diameters and a compressible foam outer layer 102*a-c*. The thickness of the foam layer 102*a-c* is selected according to the size of the core so that all balls have the same outside diameter. The foam outer layer 102*a-c* of the balls are color coded to enable balls with differing sized inner cores 100*a-c* to be easily identifiable. The size of the total ball, including inner and outer layers, is sufficiently large to substantially block the bore of drill pipe and downhole equipment through which it is pumped while allowing the ball to be pumped along the pipe by fluid pressure.

Figure 5:
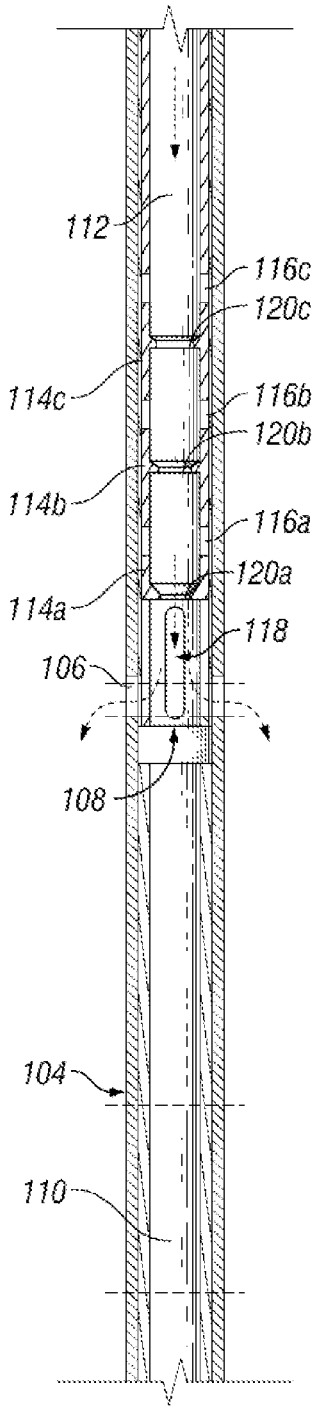
FIG. 5 shows the apparatus of the present invention prior to use.

FIG. 5 shows an embodiment of the apparatus according to the invention as configured prior to use. The apparatus comprises a cylinder 104 that can be connected at its upper end to a drill pipe or the like (not shown) extending from the surface of a well to a downhole location. A set of ports 106 are provided part way along the cylinder 104. The lower end of the cylinder is connected to a plug basket of the type generally shown in FIGS. 1-3 (not shown) containing one or more cementing plugs. A sliding piston 108 is located in the cylinder 104 below the ports 106 and an actuator rod 110 extends from the piston 108 into the plug basket. Movement of the piston 108 will be transmitted by the actuator rod 110 to the basket causing a plug to be launched into the well conduit.

The apparatus further comprises an elongate sleeve valve member 112 located in the cylinder 104 above the piston 108. The sleeve valve member 112 comprises a series of ball seats 114*a-c* spaced one above the other, for receiving a ball to block the interior of the cylinder 104. The sliding sleeve member 112 also incorporates sets of sleeve ports 116*a-c* formed in the sleeve 112 above the ball seats 114. A spacer 118 is provided between the lowest ball seat 114*a* and the piston 108.

The sleeve ports 116 are spaced apart by a distance corresponding to the amount of movement required for the piston 108 to launch a plug from the apparatus. In prior art systems such as shown in FIGS. 1 to 3 and described above, the length of the dart provides the length of downward stroke required. The present invention provides the necessary stroke length by the spacing of the sleeve ports 116.

The ball seats 114*a-c* each incorporate an aperture 120*a-c*, the apertures being arranged in a series becoming progressively larger from bottom to top and being sized so as to correspond to the cores 100*a-c* of the balls shown in FIGS. 4A-4C. Thus, the core 100*a* can pass through the apertures 120*b* and 120*c* so as to sit over aperture 120*a* ; core 100*b* can pass through aperture 120*c* so as to sit over aperture 120*b* ; and core 100*c* cannot pass through aperture 120*c* . The foam outer layers of the balls are sufficiently compressible to allow a ball with a smaller core to pass through the aperture of a seat for a larger ball core. The ball with the smallest inner core is able to fit through the apertures of all but the lowest ball seat which the smallest ball blocks. In contrast the ball with the largest inner core is unable to fit through the apertures of any of the ball seats; this ball will progress down the sliding sleeve only as far as the upper ball seat which it will block. In the configuration of FIG. 5, fluid can flow from the surface through the cylinder to exit via the cylinder ports 106. Consequently, no pressure is applied to the piston 108.

Figure 6:
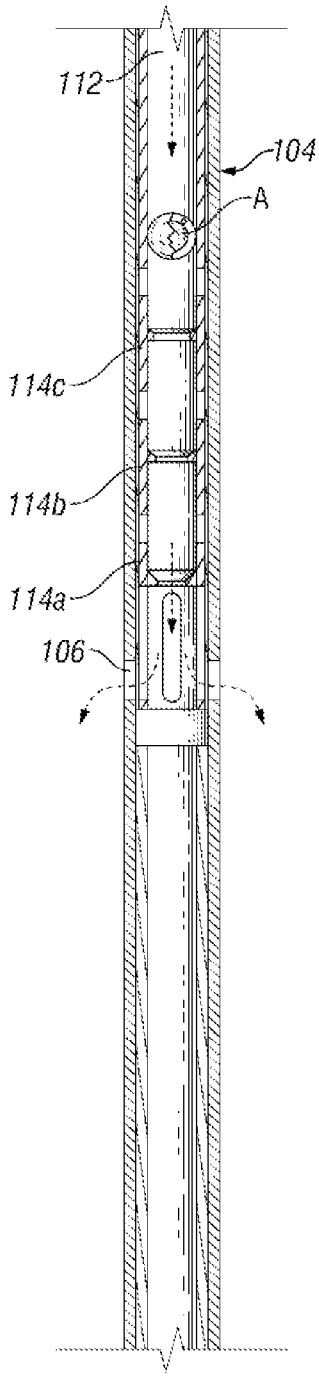
FIGS. 6 to 11 show the apparatus of the present invention in operation.
Figure 7:
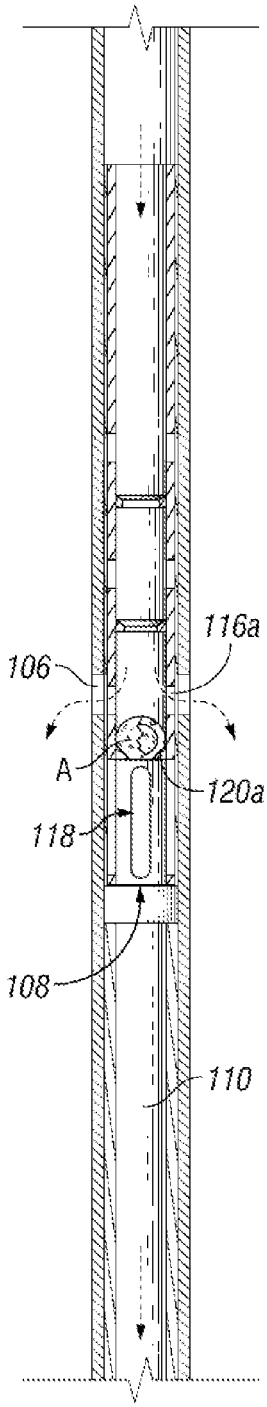

FIGS. 6-11 show the different stages of operation of a plug launching apparatus according to the invention. FIG. 6 shows a first ball A being pumped from the surface, the size of the ball is sufficient to substantially block the cylinder 104 while allowing the ball to be pumped along the cylinder 104 and sleeve 112 by fluid pressure. The first ball A to be pumped is that with the smallest inner core 100*a*, this ball (and any other that is subsequently pumped) is easily identifiable to an operator at the surface due to the colour coding system. The inner core 100*a* of the first ball A is small enough to enable it to pass through the apertures of all the ball seats in the series 114*c*, 114*b* except for the lowest ball seat 114*a*. The first ball A blocks the aperture 120*a* of the lowest ball seat 114*a* such that fluid can no longer exit via the cylinder ports 106. Continuing to apply fluid pressure from the surface above the ball A causes the sleeve 112 to advance downward in the cylinder 104. This downward movement continues until the first set of sleeve ports 116*a* align with the cylinder ports 106, allowing fluid to exit again through the cylinder ports 106 and relieving the pressure upon the ball A (see FIG. 7) such that further movement of the sleeve 112 ceases. The downward movement of the sleeve 112 is transmitted via the spacer 118 to the piston 108 and in turn via the actuator 110 to the plugs causes the lowermost plug to be launched from its basket.

Figure 8:
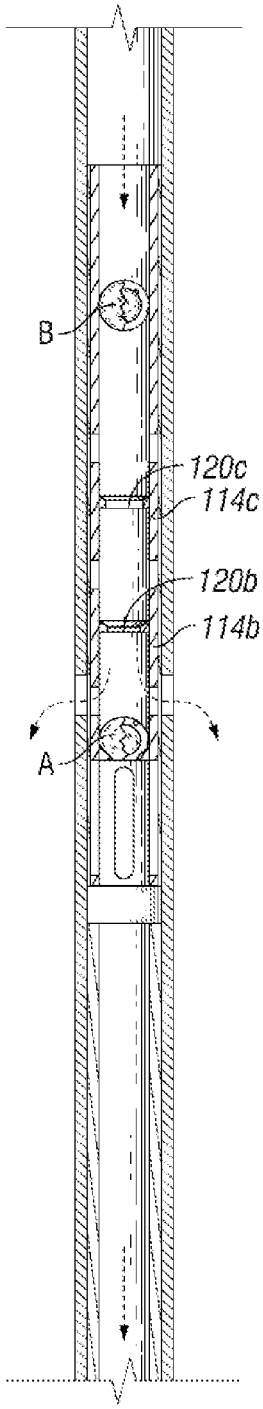
Figure 9:
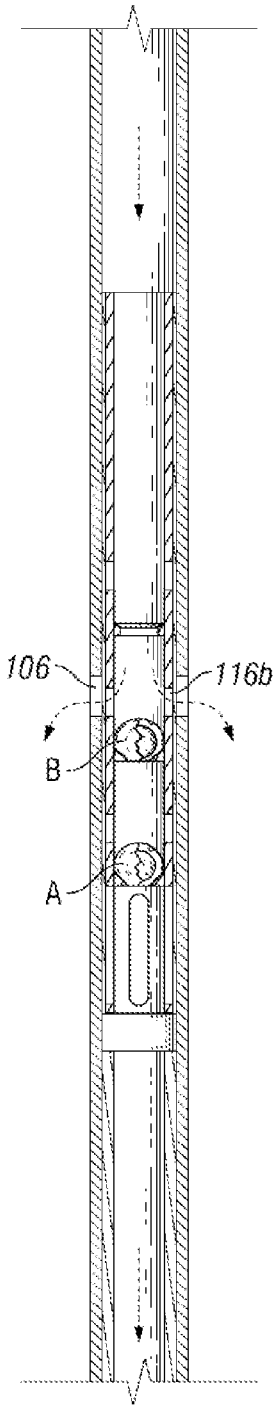

In order to provide a second stroke of the piston, a second ball B is pumped from the surface (see FIG. 8). The second ball B has an inner core 100*b* slightly larger than that 100*a* of the first ball A. However as the outer diameter is the same as the first ball A due to the compressible outer layer 102*b* the ball B functions to substantially block the cylinder while still allowing the ball to be pumped along by fluid pressure in the same way as described above. The inner core 100*b* of the second ball B is narrow enough to be able to pass through the aperture 120*c* of the ball seat 114*c* until it becomes blocked in the aperture 120*b* of the second lowest ball seat 114*b*. Fluid continues to be pumped from the surface and as the ball forms a seal with the perimeter of the sliding sleeve the sleeve is forced downwards under fluid pressure in the same manner as described above until the second set of sleeve ports 116*b* comes into alignment with the cylinder ports 106 (see FIG. 9). The downward movement of the sleeve causes a second plug to be launched from the basket in the same manner as described above.

Figure 10:
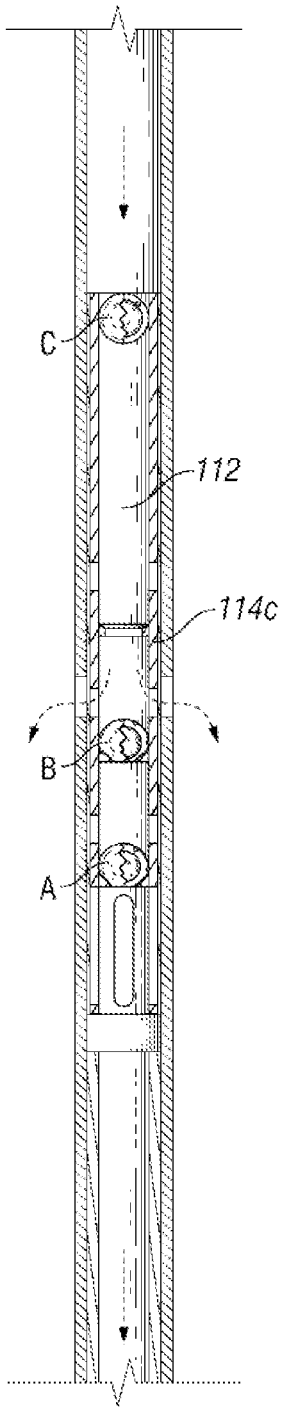
Figure 11:
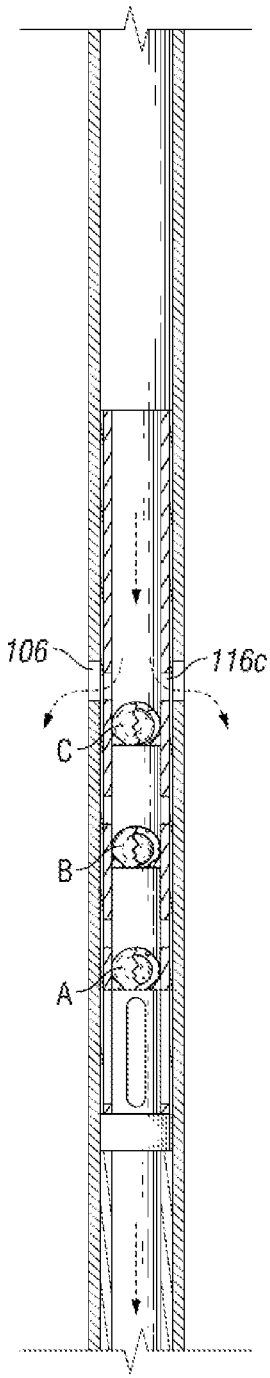

While it is common in plug launching operations to launch two plugs, it may be desirable in certain cases to launch further plugs dependent on operational need. The apparatus of the present invention may be adapted such that more than two plugs may be launched by providing a progressive series of sizes of ball seat aperture as well as the progressive series of balls with varying sized inner cores to enable this. Unlike a dart launching system, where each dart adds to the friction that must be overcome to provide the movement of the piston, the overall friction of the apparatus according to the invention remains substantially constant as it is mainly affected by the sliding friction of the sleeve in the cylinder rather than the number of balls that have been pumped. FIGS. 10 and 11 show a third ball C being deployed in a corresponding manner to balls A and B described above. The third ball C is pumped from the surface and blocks the uppermost ball seat 114*c* thereby advancing the sliding sleeve 112 downwards with a third movement. The downward movement can be used to launch a third plug and is arrested once the third set of sleeve ports 116*c* align with the cylinder ports 106.

Various changes can be made to the embodiment described above while remaining within the scope of the invention. The number of balls seats and sleeve ports can be selected to correspond to the number of plugs to be launched. The apparatus as shown in FIGS. 5-11 incorporates three ball seats and three sleeve ports; however any number of ball seats and sleeve valves may be incorporated dependent upon operational requirements. The progressive nature of the series of ball seats and inner cores sizes of the balls enables the downward movement of the sliding sleeve to occur in stages thereby providing control of the plug launching.

The ball system of the present invention can also be combined with other launching systems such as darts or the like.

The invention claimed is:

1. An apparatus for use in launching at least two cement plugs during a well cementing operation, comprising:

a cylinder having ports defined in a portion of the wall thereof;

a piston slideably received in the bore of the cylinder below the ports; and an actuator extending from the piston through the cylinder and operable by the piston for launching the cement plugs from the apparatus into the well;

wherein the apparatus further comprises an elongate sleeve valve member located in the cylinder above the piston, the sleeve valve member comprising at least two ball seats for receiving balls to block the interior of the cylinder, sleeve ports formed in the sleeve valve member above the ball seats, and a spacer extending between the ball seats and the piston, wherein the sleeve ports are spaced apart by a distance corresponding to the amount of movement required for the piston to launch a plug from the apparatus.

2. The apparatus as claimed in claim 1, wherein the ball seats are spaced one above the other, and the sleeve ports are provided in the sleeve valve member above each ball seat.

3. The apparatus as claimed in claim 2, wherein blocking of the ball seat by a ball allows the sleeve valve member to be advanced by application of fluid pressure above the ball seat until the corresponding sleeve ports are aligned with the cylinder ports.

4. The apparatus as claimed in claim 2, wherein each ball seat comprises an aperture than can be closed by a ball, the apertures becoming progressively larger from bottom to top.

5. The apparatus as claimed in claim 1, further comprising at least one ball comprising a solid core and a compressible outer layer.

6. The apparatus as claimed in claim 5, wherein the size of the ball is sufficient to substantially block the cylinder while allowing the ball to be pumped along the cylinder by fluid pressure.

7. The apparatus as claimed in claim 5, comprising a series of balls, each having a different sized core.

8. The apparatus as claimed in claim 7, wherein the outer layer is sufficiently compressible to allow a ball with a smaller core to pass through the aperture of a seat for a larger ball core.

9. The apparatus as claimed in claim 7, wherein balls with different sized cores are identifiable by colour coding of the outer layer corresponding to core size.

10. The apparatus as claimed in claim 1, further comprising a basket containing one or more cement plugs that can be launched from the basket by means of the action of the piston and actuator.

11. A method of launching a cement plugs in a well cementing operation utilizing an apparatus comprising a cylinder having ports defined in a portion of the wall thereof, a piston slideably received in the bore of the cylinder below the ports, an actuator extending from the piston through the cylinder and operable by the piston for launching a plug from the apparatus into the well; the apparatus further comprising an elongate sleeve valve member located in the cylinder above the piston, the sleeve valve member comprising a series of ball seats spaced one above the other and having apertures for receiving a ball to block the interior of the cylinder, said apertures become progressively larger from bottom to top, sleeve ports formed in the sleeve above each ball seat, and a spacer extending between the ball seat and the piston, wherein the sleeve ports are above the cylinder ports, the method comprising:

pumping a first ball through the sleeve valve member so as to pass through an upper ball seat and seat in the lowest ball seat and block fluid flow through the sleeve member;

applying fluid pressure above the first ball so as to urge the sleeve valve member downwards in the cylinder from a starting position to a second position in which the sleeve ports above the lowest ball seat are in alignment with the cylinder ports;

pumping a second ball through the sleeve valve member so as to seat in the upper ball seat and bock fluid flow through the sleeve valve member; and applying fluid pressure above the second ball so as to urge the sleeve valve member downwards in the cylinder to a third position in which the sleeve ports above the upper ball seat are in alignment with the cylinder ports;

wherein the motion of the sleeve valve member when moving between the starting position and the second position, and between the second position and the third position is transmitted via the spacer, piston and actuator to launch cement plugs from the apparatus.

12. The method as claimed in claim 11, wherein the sleeve valve member comprises one or more further ball seats above the upper ball seat, the method comprising pumping further balls to seat in the further ball seats and applying fluid pressure above the balls so as to further move the sleeve valve member to third and subsequent positions.

13. The method of claim 11, wherein at least one ball comprises a solid core and a compressible outer layer.

14. The method of claim 13, wherein the size of the ball is sufficient to substantially block the cylinder which allowing the ball to be pumped along the cylinder by fluid pressure.

15. The method of claim 13, comprising a series of balls, each having a different sized core.

16. The method of claim 15, wherein the outer layer is sufficiently compressible to allow a ball with a smaller core to pass through the aperture of a seat for a larger ball core.

17. The method of claim 11, wherein the apparatus further comprises a basket containing the cement plugs that can be launched from the basket by means of the action of the piston and actuator.

18. A method of using an apparatus for launching cement plugs in a well cementing operation, said apparatus comprising:

a cylinder having ports defined in a portion of the wall thereof;

a piston slideably received in the bore of the cylinder below the ports; and an actuator extending from the piston through the cylinder and operable by the piston for launching a plug from the apparatus into the well;

wherein the apparatus further comprises an elongate sleeve valve member located in the cylinder above the piston, the sleeve valve member comprising at least one ball seat for receiving a ball to block the interior of the cylinder, sleeve ports formed in the sleeve above the ball seat, and a spacer extending between the ball seat and the piston, the method comprising:

pumping a first ball through the sleeve valve member so as to pass through an upper ball seat and seat in the lowest ball seat and block fluid flow through the sleeve member;

applying fluid pressure above the first ball so as to urge the sleeve valve member downwards in the cylinder from a starting position to a second position in which the sleeve ports above the lowest ball seat are in alignment with the cylinder ports;

pumping a second ball through the sleeve valve member so as to seat in the upper ball seat and bock fluid flow through the sleeve valve member: and applying fluid pressure above the second ball so as to urge the sleeve valve member downwards in the cylinder to a third position in which the sleeve ports above the upper ball seat are in alignment with the cylinder ports;

wherein the motion of the sleeve valve member when moving between the starting position and the second position, and between the second position and the third position is transmitted via the spacer, piston and actuator to launch cement plugs from the apparatus.

19. The method of claim 18, wherein the apparatus further comprises a basket containing the cement plugs that can be launched from the basket by means of the action of the piston and actuator.

* * * * *